US007455127B2

(12) United States Patent
Schick

(10) Patent No.: US 7,455,127 B2
(45) Date of Patent: Nov. 25, 2008

(54) APPARATUS AND METHOD FOR IMPROVING MULTILATERAL WELL FORMATION AND REENTRY

(75) Inventor: Robert C. Schick, The Woodlands, TX (US)

(73) Assignee: KMK Trust, The Woodlands, TX (US)

( * ) Notice: Subject to any disclaimer, the term of this patent is extended or adjusted under 35 U.S.C. 154(b) by 61 days.

(21) Appl. No.: 11/379,960

(22) Filed: Apr. 24, 2006

(65) Prior Publication Data

US 2006/0260816 A1 Nov. 23, 2006

Related U.S. Application Data

(60) Provisional application No. 60/673,933, filed on Apr. 22, 2005.

(51) Int. Cl.
*E21B 7/08* (2006.01)
*E21B 23/12* (2006.01)

(52) U.S. Cl. ..... 175/61; 175/78; 175/79; 166/117.6; 166/133

(58) Field of Classification Search ..... 175/61, 175/78, 79; 166/50, 117.6, 133
See application file for complete search history.

(56) References Cited

U.S. PATENT DOCUMENTS

| | | | | |
|---|---|---|---|---|
| 2,839,270 | A | 6/1958 | McCune et al. | |
| 3,167,019 | A * | 1/1965 | Harris | 417/450 |
| 4,304,299 | A | 12/1981 | Holland et al. | |
| 4,640,353 | A * | 2/1987 | Schuh | 166/248 |
| 4,787,446 | A | 11/1988 | Howell et al. | |
| 4,807,704 | A | 2/1989 | Hsu et al. | |
| 5,148,877 | A * | 9/1992 | MacGregor | 175/79 |
| 5,253,718 | A * | 10/1993 | Lawler | 175/20 |
| 5,311,952 | A | 5/1994 | Eddison et al. | |
| 5,413,184 | A | 5/1995 | Landers | |
| 5,704,437 | A | 1/1998 | Murray | |
| 5,735,350 | A | 4/1998 | Longbottom et al. | |
| 5,853,056 | A | 12/1998 | Landers | |
| 5,894,896 | A | 4/1999 | Smith et al. | |
| 6,125,949 | A | 10/2000 | Landers | |
| 6,260,623 | B1 | 7/2001 | Schick | |
| 6,412,578 | B1 * | 7/2002 | Baird | 175/75 |
| 6,427,777 | B1 | 8/2002 | Schick | |
| 6,622,792 | B1 | 9/2003 | Schick | |
| 6,712,144 | B2 * | 3/2004 | Buytaert | 166/313 |
| 6,745,844 | B2 * | 6/2004 | Henderson | 166/386 |

(Continued)

FOREIGN PATENT DOCUMENTS

| | | |
|---|---|---|
| WO | WO 99/66168 | 12/1999 |

(Continued)

OTHER PUBLICATIONS

Brown Oil Tools, Inc. Parts List; p. 12, (undated), Houston, Texas, U.S.A.

*Primary Examiner*—Shane Bomar
(74) *Attorney, Agent, or Firm*—Crain, Caton & James

(57) ABSTRACT

An apparatus and method for improving the formation of multiple lateral wells in new and pre-existing wellbores, and positive, selective reentry of each lateral well. The apparatus comprises a tubular assembly, which includes an adjustable coupling device and a packer. The method comprises the use of the tubular assembly.

15 Claims, 3 Drawing Sheets

U.S. PATENT DOCUMENTS

| | | | | |
|---|---|---|---|---|
| 7,021,384 | B2 * | 4/2006 | Themig | 166/313 |
| 2001/0035288 | A1 | 11/2001 | Brockman et al. | |
| 2001/0045282 | A1 * | 11/2001 | Robinson | 166/298 |
| 2002/0023781 | A1 * | 2/2002 | Peters | 175/67 |
| 2002/0043404 | A1 * | 4/2002 | Trueman et al. | 175/45 |
| 2004/0149444 | A1 | 8/2004 | Cavender et al. | |
| 2004/0154805 | A1 | 8/2004 | Fontana et al. | |
| 2005/0173123 | A1 * | 8/2005 | Lund et al. | 166/361 |

FOREIGN PATENT DOCUMENTS

| | | |
|---|---|---|
| WO | WO 00/58599 | 10/2000 |

* cited by examiner

APPARATUS AND METHOD FOR IMPROVING MULTILATERAL WELL FORMATION AND REENTRY

CROSS-REFERENCE TO RELATED APPLICATIONS

The priority of U.S. Provisional Application 60/673,933, filed on Apr. 22, 2005, is hereby claimed and the specification thereof is incorporated herein by reference. This application and U.S. Pat. Nos. 6,260,623, 6,427,777 and 6,622,792, which are incorporated herein by reference, are commonly assigned to KMK Trust.

STATEMENT REGARDING FEDERALLY SPONSORED RESEARCH

Not applicable.

FIELD OF THE INVENTION

The present invention is directed to an apparatus and method for improving the formation of multiple lateral wells in new and pre-existing wellbores, and positive, selective reentry of each lateral well.

BACKGROUND OF THE INVENTION

Several advantages are provided by drilling relatively high angle, deviated or lateral wells from a generally common wellbore such as a) access to the regular oil and gas reserves without additional wells being drilled from the surface, b) avoiding unwanted formation fluids, c) penetration of natural vertical fractures, and d) improved production from various types of formations or oil and gas reserves. Additionally, reentry of one or more lateral wells is often required to perform completion work, additional drilling, or remedial and stimulation work. Thus, lateral wells have become commonplace from the standpoint of new drilling operations and reworking existing wellbores.

Ordinarily, lateral well completion and/or reentry requires expensive downhole wireline surveys to accurately position the diverter or whipstock which is used to direct the boring or completion tool through a wall of a generally vertical wellbore into the adjacent formation. Without a survey, the lateral well formed may not be accurately recorded for purposes of reentry. For example, U.S. Pat. Nos. 4,304,299; 4,807,704; and 5,704,437 each describe a method and/or apparatus for producing lateral wells from a generally vertical common wellbore using conventional techniques and tools. In each instance, one or more lateral wells may be produced at a different depth and location in the common wellbore and reentered. Consequently, the whipstock must be repositioned at the new depth and location. Each time the whipstock is repositioned at a different depth and location, the change in depth and lateral orientation relative to a point of reference is recorded. In many applications using conventional threaded connections, the exact depth and location of each lateral well formed cannot be accurately or efficiently recreated using the same system and technique. As a result, a downhole directional survey is necessary to relocate the exact depth and location of each lateral well upon reentry.

Recognizing the disadvantages of the foregoing techniques, U.S. Pat. No. 2,839,270 and, more recently, U.S. Pat. No. 5,735,350 address the need for a more accurate method and/or apparatus for producing and reentering lateral wells without the need for a directional survey. For example, U.S. Pat. No. 2,839,270 describes a technique for selectively forming a lateral well through a wall of a common wellbore at a predetermined depth and lateral orientation by means of a supporting apparatus which includes apertures formed at predetermined locations in the supporting apparatus. The apertures determine the relative depth and lateral orientation of each lateral well and are prefabricated according to the particular common wellbore in which the supporting apparatus is installed. The whipstock is then positioned using one or more specially designed latches which engage a corresponding aperture designed for receipt of the respective latch.

Similarly, U.S. Pat. No. 5,735,350 describes a method and system for creating lateral wells at pre-selected positions in a common wellbore by means of a diverter assembly having a plurality of locator keys specially designed to engage a corresponding nipple formed in the wellbore casing having a unique profile. Although this technique may be employed in new and existing wells, it is expensive and, in some instances, inappropriate because the prefabricated keys and nipples are permanently and integrally formed according to the particular formation characteristics of the common wellbore in which the system is installed.

More recently, a system and method for use in a completed wellbore lined with casing was described in U.S. Pat. No. 6,427,777. This system uses a directional survey to position an anchor at a predetermined depth and lateral orientation relative to a longitudinal position and lateral position of the desired lateral well. Because a directional survey is used to position the anchor after the casing is set and secured, the exact location of a pre-formed opening in the casing is difficult to find. And, because the system is designed for completed wellbores, the system typically requires running equipment in the wellbore which is different than the equipment used to line and secure the wellbore with casing. Finally, the casing must be milled with a different type of bit than the bit used to drill through the formation when the system is used in a completed wellbore without pre-formed openings in the casing. As a result, the system must be run in the wellbore twice to form each lateral well.

SUMMARY OF THE INVENTION

The present invention meets the above needs and overcomes one or more deficiencies in the prior art by providing an apparatus for adjusting alignment between one section of a tubular assembly and another section of the tubular assembly. The apparatus comprises a first coupler coupled to one section of the tubular assembly and a second coupler coupled to another section of the tubular assembly. The first coupler includes a plurality of grooves equidistantly spaced about the circumference of the first coupler. The second coupler includes a plurality of teeth equidistantly spaced about the circumference of the second coupler, wherein each tooth is cooperatively engaged with a corresponding groove from the plurality of grooves. The first coupler and the second coupler are fully engaged to prevent rotational movement therebetween at a first position and are partially engaged to prevent incremental rotational movement therebetween at a second position.

In another embodiment, the present invention provides a packer for use in forming a lateral borehole through the wall of a wellbore. The packer comprises a first passage having an opening in an upper portion of the packer and a side opening in the packer and a second passage having an opening in the upper portion of the packer and an opening into the first passage for fluid communication between the first passage opening in the uppoer portion of the packer and the second passage opening in the upper portion of the packer.

In yet another embodiment, the present invention provides a method for forming a lateral borehole through a wall of a wellbore with a packer having a first passage in fluid communication with a second passage. The method comprises: i) setting the packer at a predetermined depth and azimuth; ii) positioning a flexible boring tool through the first passage and a side opening in the packer; iii) forming the lateral borehole with the flexible boring tool; and iv) pumping a fluid through the second passage and a portion of the first passage.

BRIEF DESCRIPTION OF THE DRAWINGS

The present invention is described in detail below with reference to the attached drawing figures, wherein.

DESCRIPTION OF PREFERRED EMBODIMENTS

Figure 1:
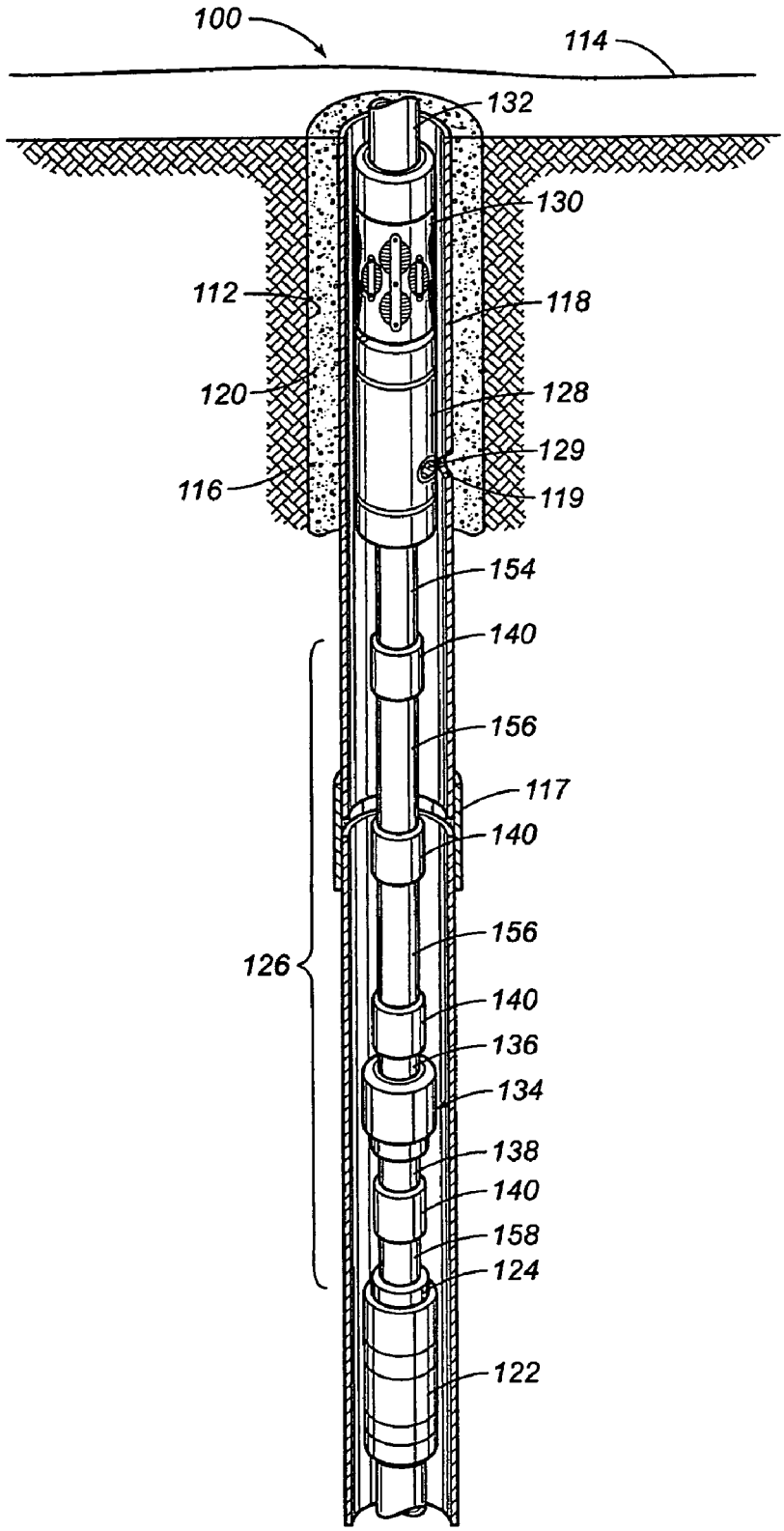
FIG. 1. is an elevational view of a tubular assembly illustrating the adjustable coupling apparatus and the packer of the present invention in partial cross-section.

In the description which follows, like parts are marked throughout this description in drawings with the same reference numerals, respectively. The drawing figures are not necessarily to scale. Certain features of the invention may be shown exaggerated, in scale or in schematic form, in some details of conventional elements may not be shown in the interest of clarity and conciseness.

FIG. 1 is an elevational view of a tubular assembly 100 shown in partial cross-section and illustrates one embodiment of the present invention. The tubular assembly 100 may be used in both new and preexisting well environments and is generally shown within a main well bore 112 that has been drilled generally vertically into a surface 114 of the earth in a conventional manner. The well bore 112 extends generally vertically downward into an area of the formation 116 where it may also be desired to induce or inject fluids. In this embodiment, the well bore 112 is generally vertical, however, may extend in other non-vertical directions approaching horizontal. The main casing 118 may be set and secured in the well bore 112 with a cement liner 120 in a conventional manner or in the manner described in U.S. Pat. No. 6,622,792. Generally, the casing 118 comprises multiple segments that may be connected at the surface 114, wherein each connection forms a casing joint 117, as the casing 118 is lowered into the well bore 112. Preferably, at least one of the casing segments includes a preformed opening or window 119 in the casing 118. The opening 119 may be covered by a fiberglass mesh (not shown) or any other substantially impermeable material to prevent the cement liner 120 from compromising the annulus between the drill string 132 and the casing 118.

The tubular assembly 100 comprises a first anchor 122, an orienting member 124, an extension member 126, a packer 128 and a second anchor 130. The first anchor 122 may include a conventional packer design or it may be designed in the same manner as the anchor described in U.S. Pat. No. 6,427,777. The first anchor 122 may be positioned within the well bore 112 at a predetermined position using a drill string 132 comprising segments of connected drill pipe. The predetermined position of the first anchor 122 may be determined by any conventional survey means, such as a directional down hole survey of the formation 116 to determine the depth (longitudinal position) and azimuth (lateral orientation) of the first anchor 122. A conventional directional survey of the well bore 112 therefore, should reveal the longitudinal position and lateral direction of each region or area of the formation 116 where hydrocarbons may be found. Based upon the survey results, the appropriate number of lateral boreholes may be determined at a given depth and azimuth. The casing 118 may include multiple preformed openings, like opening 119, which may be aligned with each corresponding area of the formation 116 where a lateral borehole is desired. Thus, the casing 118 and the first anchor 122 may be made up and lowered into the well bore 112 until the opening 119 is generally aligned with an area of the formation 116 where a lateral borehole is desired. The longitudinal position and lateral orientation of the opening 119 may be generally aligned with an area of the formation 116 where a lateral borehole is desired by reference to a longitudinal reference point and lateral reference point located on the first anchor 122 in the manner described in U.S. Pat. No. 6,427,777. If, however, the casing 118 does not include opening 119, then the first anchor 122 and the casing 118 may be made up and lowered into the well bore 112 adequately below an area of the formation 116 where a lateral borehole furtherest from the surface 114 is desired.

Once the casing 118 and the first anchor 122 are set and secured in the well bore 112, the orienting member 124, the extension member 126, the packer 128 and the second anchor 130 may be lowered into the well bore 112 until the orienting member 124 is slidably engaged within the first anchor 122. The first anchor 122 may be modified to include the longitudinal reference point and the lateral reference point in most applications after the first anchor 122 is permanently secured.

The side opening 129 in the packer 128 may be aligned with the opening 119 in the casing 118 using the extension member 126. Alternatively, the side opening 129 in the packer 128 may be generally positioned at a predetermined longitudinal position and lateral orientation corresponding with a preferred area of the formation 116 where a lateral bore hole may be desired. The extension member 126 includes one end 158 connected to the orienting member 124 and another end 154 connected to the packer 128. The length of the extension member 126 may be varied by using one or more shorter or longer drill pipe segments 156. Each unilateral connection 140 maintains lateral orientation and alignment between the orienting member 124 and the side opening 129 in the packer 128. Each unilateral connection 140 and drill pipe segment 156 may be designed and made up in the manner described in U.S. Pat. No. 6,427,777. An adjustable coupling device 134 permits the lateral orientatin of the packer 128 to be adjusted in preselected increments as more particularly described in reference to FIGS. 3A and 3B.

The packer 128 may therefore, be positioned at any predetermined depth and lateral orientation by using the first anchor 122, the orienting member 124 and the extension member 126. The first anchor 122 and the orienting member 124 may therefore, be constructed and operated in the same manner as the anchor and the orienting member described in U.S. Pat. Nos. 6,427,777 and 6,662,792. Alternatively, the first anchor 122 and the orienting member 124 may be constructed and operated in the same manner as the bridge plug and orienting device described in U.S. Pat. No. 6,260,623. A second anchor 130 may be positioned above the packer 128 for additional stability, if necessary. The second anchor 130 may include another packer and/or slips, which may be integral with, or connected to, the packer 128.

Figure 2A:
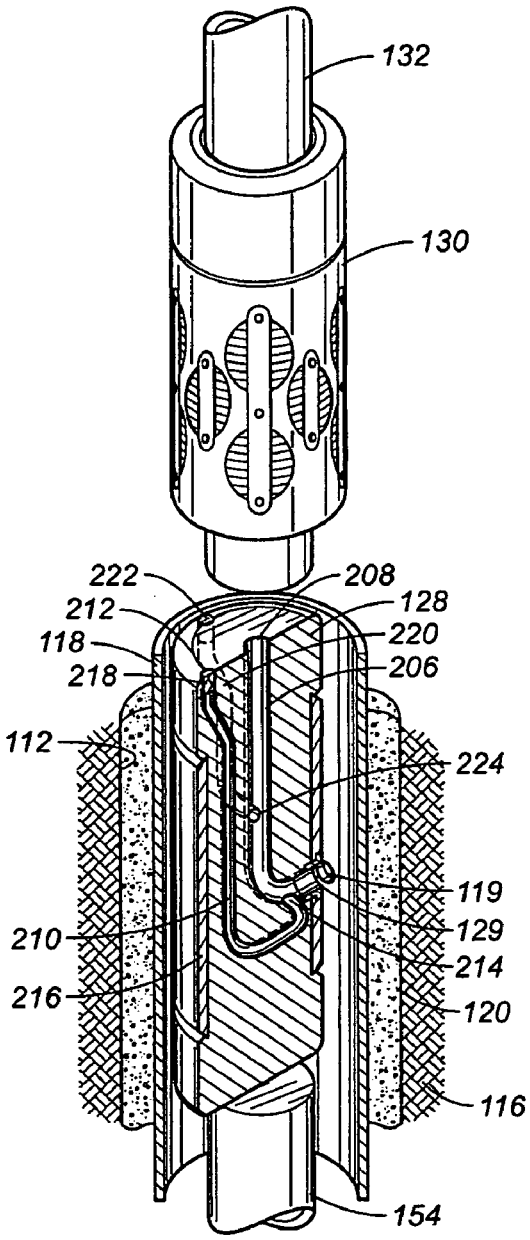
FIG. 2A is a cross-sectional view of the packer illustrated in FIG. 1.
Figure 2B:
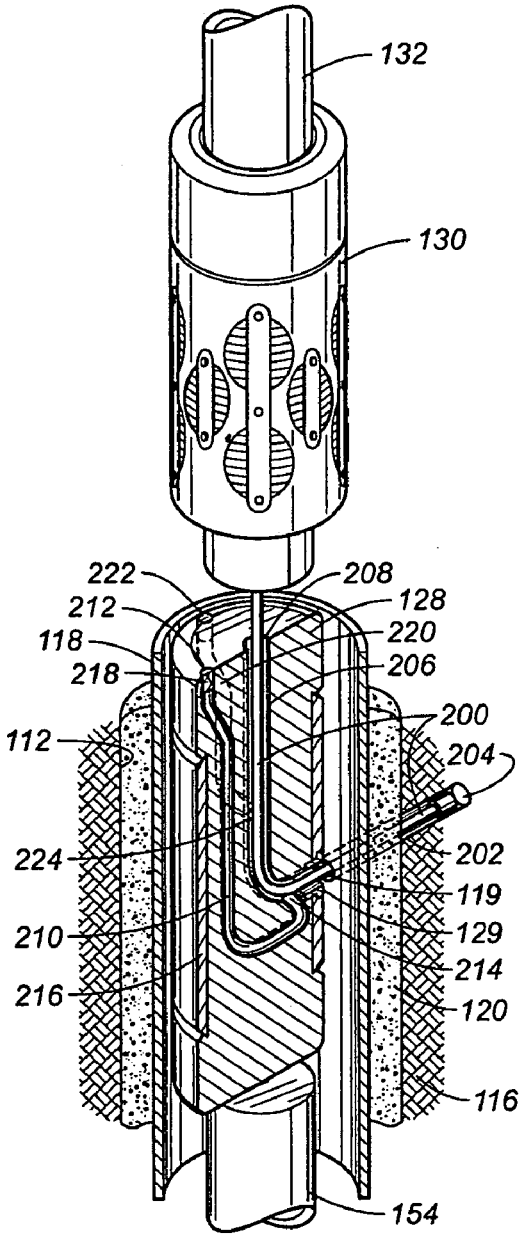
FIG. 2B is a cross-sectional view of the packer illustrated in FIG. 1 and a flexible boring tool inserted there through into a formation.

Referring now to FIGS. 2A and 2B, cross-sectional views of the packer 128 are illustrated with (FIG. 2B) and without (FIG. 2A) a flexible boring tool 200. The flexible boring tool 200 may include a conventional drill bit or a fluid jet nozzle at a distal end 204 for use in forming a lateral bore hole 202 through the cement liner 120, a wall of the well bore 112 and into the formation 116. The flexible boring tool 200 may be positioned at the lower end of a coil tubing string. In the event that a fluid jet nozzle is preferred at the distal end 204 the flexible boring tool 200, the fluid jet nozzle may be designed and operated in the manner described in U.S. Pat. No. 6,260,623 to bore through and/or stimulate the formation 116 with one of a fluid and another fluid.

The packer 128 includes a first passage 206 for receipt of the flexible boring tool 200 and at least one of the fluid and the another fluid. The first passage 206 has an opening 208 centrally positioned in an upper portion of the packer 128 and a side opening 129. The first passage 206 may extend from the first passage opening 208 in the upper portion of the packer 128 to the surface 114 of the well bore 112 through the drill string 132. The packer 128 also includes a second passage 210 for receipt of one of the fluid and the another fluid. The second passge 210 has an opening 212 in the upper portion of the packer 128 and an opening 214 into the first passage for fluid communication between the first passage opening 208 in the upper portion of the packer 128 and the second passage opening 212 in the upper portion of the packer 128. The second passage opening 214 into the first passage 206 may be closer to the side opening 129 than to the first passage opening 208 in the upper portion of the packer 128.

The packer 128 may be expanded to engage the side opening 129 of the packer 128 with the lateral bore hole 202. The packer 128 may be expanded with a sealing element 216, which substantially prevents the fluid, the another fluid and/or formation cuttings from passing between the formation 116 and an annulus between the casing 118 and the drill string 132.

The second passage opening 214 into the first passage 206 is positioned to direct at least one of the fluid and the another fluid toward the first passage opening 208 in the upper portion of the packer 128. One of the fluid and the another fluid therefore, enters the second passage opening 212 in the upper portion of the packer 128 and exits through the first passage opening 208 in the upper portion of the packer 128 for controlling at least one of a plurality of entrained cuttings from the formation of the lateral bore hole 202 and a hydrostatic pressure between the well bore 212 and the lateral bore hole 202. A check valve 218 may be positioned in the second passage 210 near the second passage opening 212 in the upper portion of the packer 128 to prevent one of the fluid and the another fluid from circulating away from the second passage opening 214 into the first passage 206 toward the second passage opening 212 in the upper portion of the packer 128.

The fluid and the another fluid may comprise at least one of a liquid and a gas that are introduced through the drill string 132 to the second passage opening 212 in the upper portion of the packer 128 and the flexible boring tool 200. The fluid and the another fluid therefore, may or may not comprise the same fluid.

The selection of the fluid and the another fluid may depend on the desire to control the velocity and the volume of entrained formation cuttings flowing through the first passage 206 and/or the hydrostatic pressure between the well bore 112 and the lateral bore hole 202. For example, selection of a heavier fluid raises the hydrostatic pressure. Conversely, selection of a lighter fluid lowers the hydrostatic pressure. A gas, such as oxygen or nitrogen, or a combined liquid and gas (foam) may therefore, be used as the fluid or the another fluid in the second passage 210 to lower the hydrostatic pressure. A liquid or a gel, however, may be preferred to carry more formation cuttings and reduce the slip of such cuttings. As the velocity of the fluid or the another fluid is increased through the second passage 210, more formation cuttings may be carried (entrained) through the first passage 206.

In another embodiment, the packer 128 may comprise a third passage 220 for receipt of one of the fluid and the another fluid. The third passage 220 has an opening 222 in the upper portion of the packer 128 and an opening 224 into the first passage 206 for fluid communication between the third passage opening 222 in the upper portion of the packer 128 and the first passage opening 208 in the upper portion of the packer 128. The third passage 220 may be used to improve the velocity and the volume of entrained cuttings flowing from the formation of the lateral bore hole 202 through the first passage 206 and control the hydrostatic pressure between the well bore 112 and the lateral bore hole 202 in the same manner as described in reference to the second passage 210.

In this embodiment, for example, the first passage 206 may comprise an independent passage throughout the full length of the drill string 132, while the second passage 210 and the third passage 220 may be limited to the packer 128. The one of the fluid and the another fluid may be introduced through the flexible boring tool 200, which returns, with the formation cuttings, through the first passage 206 in the drill string 132 to the surface 114 of the well bore 112 in FIG. 1. The one of the fluid and the another fluid may also be introduced through the second passage 210 and the third passage 220, which returns, with the formation cuttings, through a portion of the first passage 206 in the drill string 132 to the surface 114 of the well bore 112 in FIG. 1. The one of the fluid and the another fluid may be introduced through the annulus between the casing 118 and the drill string 132 to the second passage opening 214 and the third passage opening 222 in the upper portion of the packer 128. In this manner, the fluid and/or the another fluid may originate from the same, or separate, source (s) and return through the first passage 206 in the drill string 132 to the same source at the surface 114 of the well bore 112 in FIG. 1.

The packer 128 may therefore, be used to form the lateral bore hole 202 through a wall of the well bore 112 by first setting the packer 128 at a predetermined depth (longitudinal position) and azimuth (lateral orientation) as described in reference to FIG. 1. The side opening 129 of the packer 128 is initially aligned with the opening 119 in the casing 118. The flexible boring tool 200 is then positioned through the first passage 206 and the side opening 129 in the packer 128. If milling through the casing 118 is unnecessary, then the flexible boring tool 200 may be fitted with a drilling bit or fluid jet nozzle at its distal end 204 that is capable of forming the lateral bore hole 202 through a preferred area of the formation 116. In one embodiment, the fluid jet nozzle may be used to form the lateral bore hole 202 by introducing one of a fluid and another fluid through the fluid jet nozzle attached to the distal end 204 of the flexible boring tool 200 at a high velocity to form the lateral bore hole 202. As the lateral bore hole 202 is formed, formation cuttings and one of the fluid and the another fluid are forced through the lateral bore hole 202 and the side opening 129 of the packer 128 into the first passage 206. The sealing element 216 substantially prevents formation cuttings and one of the fluid and the another fluid from entering the annulus between the casing 118 and the drill string 132.

In order to facilitate entrainment of the formation cuttings and one of the fluid and the another fluid into the first passage 206, one of the fluid and the another fluid may be introduced through the second passage 210 and a portion of the first passage 206, between the second passage opening 214 into the first passage 206 and the first passage opening 208 in the upper portion of the packer 128, at a sufficient velocity to entrain the formation cuttings and at least one of the fluid and the another fluid through the first passage opening 208 in the upper portion of the packer 128, away from the side opening 129 in the packer 128. Introducing one of the fluid and the another fluid through the second passage 210 and the portion of the first passage 206 may also control hydrostatic pressure between the well bore 112 and the lateral bore hole 202.

Once the lateral bore hole 202 is formed, the process may be repeated as described to form multiple lateral bore holes, at the same depth or longitudinal position, without removing the packer 128 from the well bore 112. The packer 128 may therefore, be used to entrain formation cuttings, control hydrostatic pressure and/or drill in underbalanced conditions.

Figure 3A:
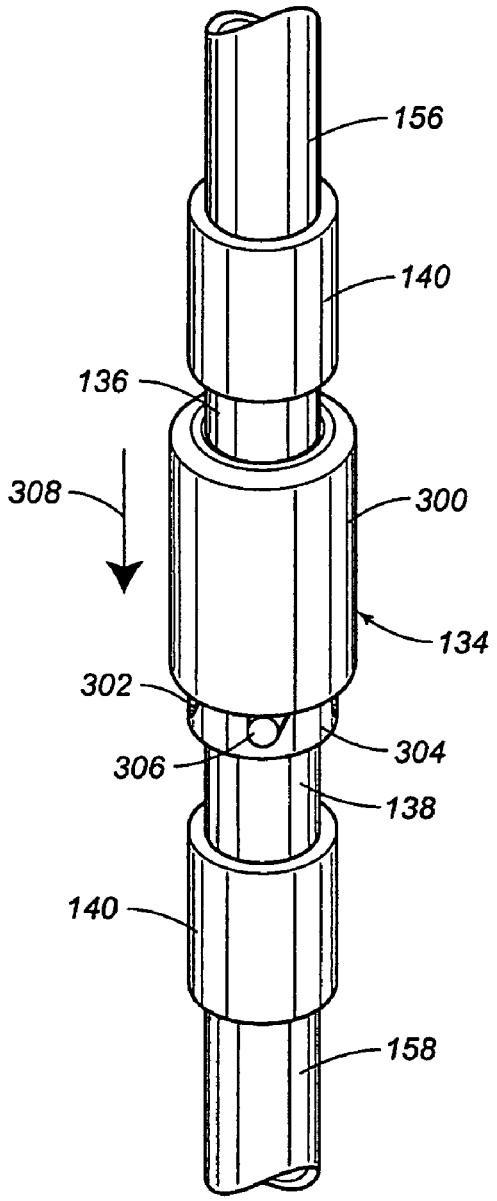
FIG. 3A is an elevational view of the adjustable coupling apparatus illustrated in FIG. 1, fully engaged.
Figure 3B:
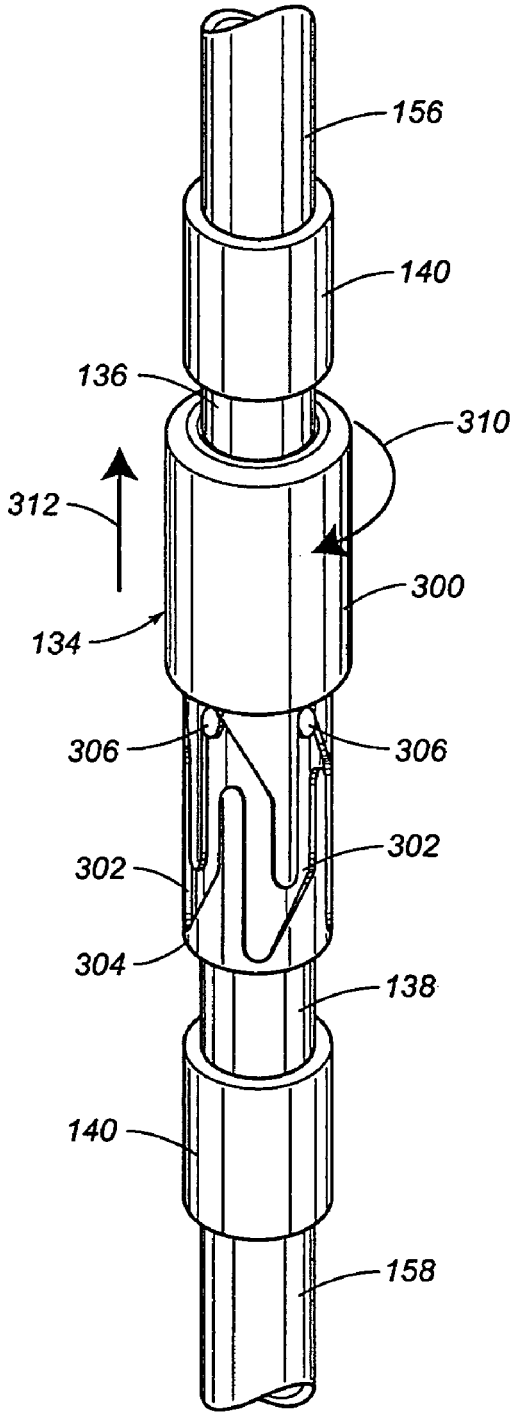
FIG. 3B is an elevational view of the adjustable coupling apparatus illustrated in FIG. 1, partially engaged.

Referring now to FIGS. 3A and 3B, elevational views of the adjustable coupling apparatus 134 are illustrated in a fully engaged first position (FIG. 3A) and a partially engaged second position (FIG. 3B). The adjustable coupling apparatus 134 may be used to align the packer 128 with an opening in the casing 118 or preferred lateral orientation to form a lateral bore hole without removing the packer 128 from the well bore 112. The adjustable coupling apparatus 134 therefore, may be used to adjust alignment between one section of the tubular assembly 100 connected to one end 138 of the adjustable coupling apparatus 134 and another section of the tubular assembly 100 connected to another end 136 of the adjustable coupling apparatus 134. The adjustable coupling apparatus 134 includes a first coupler 300 coupled to the one section of the tubular assembly 100 at the another end 136, and a second coupler 304 coupled to the another section of the tubular assembly 100 at the end 138. The first coupler 300 includes a plurality of grooves 302 equidistantly spaced about a circumference of the first coupler 300. The second coupler 304 includes a plurality of teeth 306 equidistantly spaced about a circumference of the second coupler 304. Each tooth 306 is cooperatively engaged with a corresponding groove 302.

In FIG. 3A, the first coupler 300 and the second coupler 304 are fully engaged at a first position by a force 308. The first coupler 300 and the second coupler 304 are restricted from rotational movement at the fully engaged first position. In FIG. 3B, the first coupler 300 and the second coupler 304 are partially engaged at a second position by a force 312. The first coupler 300 and the second coupler 304 may be incrementally rotated in a clockwise direction 310 at the partially engaged second position. Alternatively, the adjustable coupling apparatus 134 may be designed to permit full engagement between the first coupler 300 and the second coupler 304 by a force in a direction opposite to the force 308 illustrated in FIG. 3A. Likewise, the adjustable coupling apparatus 134 may be designed to permit partial engagement by a force in a direction opposite to the force 312 illustrated in FIG. 3B. The adjustable coupling apparatus 134 may also be designed to permit incremental rotational movement between the first coupler 300 and the second coupler 304 in a counterclockwise direction, instead.

The first coupler 300 and the second coupler 304 therefore, permit rotational alignment in a single direction between the one section of the tubular assembly 100 and another section of the tubular assembly 100. The first coupler 300 and the second coupler 304 are therefore, longitudinally movable between the first position illustrated in FIG. 3A and the second position illustrated in FIG. 3B. The adjustable coupling apparatus 134 enables the packer 128 to be used with the flexible boring tool 200 to form multiple equidistantly spaced lateral bore holes at the same depth or longitudinal position within the well bore 112. As illustrated in reference to FIG. 1, additional lateral bore holes may be formed at other depths or longitudinal positions by removing the tubular assembly 100 and adjusting the length of the extension member 126. Accordingly, the tubular assembly 100 may be utilized to form multiple lateral bore holes through a wall of the well bore 112 at multiple lateral positions at the same or different longitudinal positions (depths) in preexisting or new well bores with fewer runs and fewer tools.

Because the tubular assembly 100 comprises many conventional or standard components, this tubular assembly 100 costs less to manufacture than any alternative systems, which may require specially designed casing and other components manufactured in accordance with the specific requirements of the particular site and well bore. Additionally, the tubular assembly 100, and use thereof, may be employed in new and preexisting well bores using the same components, which substantially reduces production costs.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

The invention claimed is:

1. A packer for use on a drill string in forming a lateral borehole though a wall of a wellbore, comprising:

a first passage having an opening in an upper portion of the packer and a side opening in the packer; and a second passage having an opening in the upper portion of the packer for fluid communication between an annulus above the packer and the second passage and an opening connected to the first passage between the first passage opening in the upper portion of the packer and the side opening in the packer for fluid communication between the first passage opening in the upper portion of the packer and the second passage opening in the upper portion of the packer when a fluid is pumped from the second passage into the first passage.

2. The packer of claim 1, wherein the packer is expandable for engaging the side opening in the packer with casing or the wall of the wellbore and substantially isolating the lateral borehole from the annulus above the packer and an annulus below the packer.

3. The packer of claim 1, wherein the first passage is for receipt of a flexible tool for forming the lateral borehole and at least one of a fluid and another fluid.

4. The packer of claim 3, wherein the second passage is for receipt of one of the fluid and the another fluid.

5. The packer of claim 4, wherein the fluid and the another fluid comprise at least one of a liquid and a gas.

6. The packer of claim 4, wherein the opening of the second passage connected to the first passage is positioned to direct at least one of the fluid and the another fluid toward the first passage opening in the upper portion of the packer.

7. The packer of claim 6, wherein the one of the fluid and the another fluid enters the second passage opening in the upper portion of the packer from the annulus above the packer and exits through the first passage opening in the upper portion of the packer for controlling at least one of a plurality of entrained cuttings from the formation of the lateral borehole and a hydrostatic pressure between the wellbore and the lateral borehole.

8. The packer of claim 1, wherein the opening of the second passage connected to the first passage is closer to the first passage side opening than to the first passage opening in the upper portion of the packer.

9. The packer of claim 1, wherein the first passage opening is centrally positioned in the upper portion of the packer.

10. The packer of claim 1, further comprising a check valve positioned in the second passage.

11. The packer of claim 1, further comprising a third passage having an opening in the upper portion of the packer for fluid communication between the annulus above the packer and the third passage and an opening connected to the first passage for fluid communication between the third passage opening in the upper portion of the packer and the first passage opening in the upper portion of the packer when the fluid or another fluid is pumped from the third passage into the first passage.

12. A method for forming a lateral borehole through a wall of a wellbore with a drill string and a packer having a first passage in fluid communication with a second passage, comprising:

setting the packer at a predetermined depth and azimuth;

positioning a flexible boring tool through the first passage and a side opening in the packer;

forming the lateral borehole with the flexible boring tool; and pumping a fluid through the second passage and a portion of the first passage from an annulus formed between the drillstring and casing or the wall of the wellbore above the packer through an opening in an upper portion of the packer into the second passage; and pumping the fluid from the second passage through a portion of the first passage and out of the first passage through another opening in the upper portion of the packer.

13. The method of claim 12, farther comprising the step of receiving another fluid through the side opening in the packer.

14. The method of claim 13, wherein pumping the fluid through the second passage and the portion of the first passage entrains cuttings and the another fluid from the formation of the lateral borehole into the first passage with the fluid.

15. The method of claim 13, wherein pumping the fluid through the second passage and the portion of the first passage controls hydrostatic pressure between the wellbore and the lateral borehole.

* * * * *

UNITED STATES PATENT AND TRADEMARK OFFICE

CERTIFICATE OF CORRECTION

PATENT NO. : 7,455,127 B2
APPLICATION NO. : 11/379960
DATED : November 25, 2008
INVENTOR(S) : Robert C. Schick It is certified that error appears in the above-identified patent and that said Letters Patent is hereby corrected as shown below:

Title page of Patent:

Item (56) References Cited should include:

U.S. Patent Documents

2000/0058599
1999/0066168 col. 10, ln. 15 claim 13: “farther” should read “further”

Signed and Sealed this

Thirty-first Day of March, 2009

John Doll

JOHN DOLL
*Acting Director of the United States Patent and Trademark Office*